US008816930B2

(12) United States Patent
Fonseca

(10) Patent No.: US 8,816,930 B2
(45) Date of Patent: Aug. 26, 2014

(54) WAVEGUIDE ORTHOMODE TRANSDUCER

(75) Inventor: Nelson Fonseca, Noordwijk (NL)

(73) Assignee: Centre National d'Etudes Spatiales (FR)

( * ) Notice: Subject to any disclaimer, the term of this patent is extended or adjusted under 35 U.S.C. 154(b) by 594 days.

(21) Appl. No.: 13/147,460

(22) PCT Filed: Feb. 1, 2010

(86) PCT No.: PCT/EP2010/051180

§ 371 (c)(1), (2), (4) Date: Oct. 6, 2011

(87) PCT Pub. No.: WO2010/086442

PCT Pub. Date: Aug. 5, 2010

(65) Prior Publication Data

US 2012/0032867 A1 Feb. 9, 2012

(30) Foreign Application Priority Data

Feb. 2, 2009 (EP) ..... 09305099

(51) Int. Cl.
*H01Q 1/50* (2006.01)

(52) U.S. Cl.
USPC ..... 343/850; 333/137

(58) Field of Classification Search
USPC ..... 343/850; 333/137, 135, 126, 21 A, 21 R
See application file for complete search history.

(56) References Cited

U.S. PATENT DOCUMENTS

| | | | | |
|---|---|---|---|---|
| 2,849,688 | A * | 8/1958 | Ayers et al. | 333/122 |
| 7,330,088 | B2 | 2/2008 | Aramaki et al. | |
| 7,408,427 | B1 * | 8/2008 | Lee-Yow et al. | 333/126 |

FOREIGN PATENT DOCUMENTS

| | | | |
|---|---|---|---|
| JP | 60-001902 | A | 1/1985 |
| JP | 60-160702 | | 8/1985 |
| WO | 2008/008702 | A2 | 1/2008 |

OTHER PUBLICATIONS

International Search Report, PCT/EP2010/051180, dated Jun. 8, 2010.

Navarrini et al., "A Turnstile Junction Waveguide Orthomode Transducer" IEEE Transactions on Microwave Theory and Techniques, 54(1); 272-277 (2006).

* cited by examiner

*Primary Examiner* — Karl D Frech
(74) *Attorney, Agent, or Firm* — Lerner, David, Littenberg, Krumholtz & Mentlik, LLP

(57) ABSTRACT

A waveguide orthomode transducer, comprises: a junction having a main waveguide and four auxiliary waveguides lying along the two orthogonal main axis of the junction and defining four quadrants; a combination network comprising: two magic tees, each having an E-port, two opposed common-ports, and a H-port; an H-plane tee junction having a Σ-port and two opposed common-ports; and an E-plane tee junction having a Δ-port and two opposed common-ports. Two auxiliary waveguides define a first quadrant are respectively connected to the common-ports of one of the magic tees and the two other secondary waveguides defining a second quadrant opposite to the first quadrant are connected to the common-ports of the other magic tee. The tee junctions are used to connect similar magic tee ports so that the transducer separates towards two different outputs two orthogonally polarized signals entering at the main waveguide. Reciprocally, two signals entering respectively in the Σ-port and the Δ-port of the tees junctions are combined with orthogonal polarizations in the main waveguide.

11 Claims, 6 Drawing Sheets

WAVEGUIDE ORTHOMODE TRANSDUCER

CROSS REFERENCE TO RELATED APPLICATIONS

The present application is a national phase entry under 35 USC §371 of International Application No. PCT/EP2010/051180, filed Feb. 1, 2010, which claims the benefit of and priority to European Patent Application No. 09305099.5, filed Feb. 2, 2009, the entire disclosures of which are incorporated herein by reference.

FIELD OF THE INVENTION

The invention relates to wave transmission lines used as feeding network for antennas and more particularly to a feeding network known as orthomode transducer used to combine/separate two orthogonal polarizations.

BACKGROUND OF THE INVENTION

Orthomode transducers (OMT) are of great interest in various applications as they enable to combine or separate two signals in orthogonal polarizations.

In telecommunications, for instance, these components permit an efficient use of the available bandwidth. In radar applications, one may use these components to separate the transmitted and received signals if they are in orthogonal polarizations.

These components are also of interest in measurement setups like compact range, long range or near field, as two orthogonal linear polarizations can be measured simultaneously.

A very convenient base to design a waveguide technology OMT is a turnstile junction as this component has wide band high power handling behavior.

FIG. 1 illustrates a conventional turnstile junction.

It consists in a circular main waveguide 10 and four secondary rectangular waveguides 11-14 that lie in a common plane along the orthogonal main axis AA', BB' of the junction. The turnstile junction 1 can be seen as the superposition of two H-plane power dividers with a 90 degrees rotation.

Used as an antenna feeding network, the circular main waveguide 10 is connected to the antenna port.

Depending on the use of the antenna (for transmit or receive), the circular main waveguide 10 is considered as an output or an input and accordingly the OMT combines or separate orthogonal polarizations.

To simplify the description, let assume in the following description that the OMT is used to separate two orthogonal linear polarizations received by the antenna.

A radio-frequency signal including a vertically polarized mode $\mathbf{20}_V$ and a horizontally polarized mode $\mathbf{20}_H$ enters in the main circular waveguide 10 of the junction according to the orientation defined by the main axis AA', BB' of the junction 1.

The vertically polarized field 20, is divided into two out-of-phase signal portions $\mathbf{21}_a$ and $\mathbf{21}_b$ that exit the junction by the two opposed ports 11 and 13 respectively. Similarly the horizontally polarized field $\mathbf{20}_H$ is divided into two out-of-phase signal portions $\mathbf{21}_a$ and $\mathbf{21}_b$ that exit the junction by the two other opposed ports 12 and 14 respectively.

With this junction, a linearly polarized electromagnetic field is naturally directed towards the rectangular waveguides 11-14 having the same axis direction.

Then, each pair of opposite waveguides needs to be recombined through a power divider/combiner. But due to the particular geometry of the turnstile junction, radio-frequency paths crossing usually lead to a large, non symmetrical geometry network such as the one described in document "*A Turnstile Junction Waveguide Orthomode Transducer*," A. Navarrini et al., IEEE Transactions on Microwave Theory and Techniques.

The latter characteristic may have an impact on bandwidth performances and also on higher order modes generation.

Some solutions to overcome these drawbacks are already known.

One solution using waveguide cross-section reduction is described in document U.S. Pat. No. 7,330,088. This leads to a very compact symmetrical design. However cross-section reduction is known to limit power handling which is of great concern for telecommunication applications since the current trend is to increase the transmitted power per antenna.

Another solution is described in document WO 2008/008702. This design uses four magic tees to suppress radio-frequency path crossings. However this design leads to a combination network that requires three components per radio-frequency path compared to only one with previous designs. This may result in increased insertion losses and higher sensitivity to manufacturing precision.

SUMMARY OF THE INVENTION

The aim of the invention is to obtain a waveguide orthomode transducer which requires a low number of components and offers good performance, particularly in terms of power handling and higher order modes generation.

According to a first aspect, the invention concerns a waveguide orthomode transducer, comprising: a junction having a main waveguide and four auxiliary waveguides lying along the two orthogonal main axis of the junction and defining four quadrants; a combination network comprising: two magic tees, each having an E-port, two opposed common-ports, and a H-port; an H-plane tee junction having a Σ-port and two opposed common-ports; and an E-plan tee junction having a Δ-port and two opposed common-ports.

The waveguide orthomode transducer of the invention is characterized in that: two auxiliary waveguides defining a first quadrant are respectively connected to the common-ports of one of the magic tees and the two other secondary waveguides defining a second quadrant opposite to the first quadrant are connected to the common-ports of the other magic tee; and in that tee junctions are used to connect similar magic tee ports (E or H-ports); so that the transducer separates towards two different outputs two orthogonally polarized signals entering at said main waveguide and reciprocally two signals entering respectively in the Σ-port and the Δ-port of the tees junctions are combined with orthogonal polarizations in said main waveguide.

In the waveguide orthomode transducer of the invention the tee junctions are in particular used to connect similar magic tee ports (i.e., E or H-ports).

The two H-plane ports of the magic tees are then connected through an E-plane tee junction while the two E-plane ports of the same magic tees are connected through an H-plane tee junction.

The invention permits to obtain a waveguide orthomode transducer with a compact structure without crossings and requires only two components per radio-frequency path.

The waveguide orthomode transducer of the invention is less sensitive to higher order modes due to its symmetrical topology per access.

Used with a turnstile junction, the waveguide orthomode transducer of the invention has a high power handling threshold when compared to other state-of-art compact waveguide orthomode transducers.

The waveguide orthomode transducer of the invention appears as a trade-off solution in complexity and performances between all the already known solutions.

The E-ports of each magic tees can be connected to the common-ports of the H-plane tee junction; and the H-ports of each magic tees can be connected to the common ports of the E-plane tee junction.

The main waveguide may have a circular, square or octagonal cross-section.

The auxiliary waveguides can be rectangular waveguides with longest side orthogonal to the main waveguide longitudinal axis, the junction being a turnstile junction; or rectangular waveguides with longest side parallel to the main waveguide longitudinal axis.

The waveguide orthomode transducer of the invention is adapted to receive/transmit a radio frequency signal including two orthogonal linearly polarized electromagnetic fields with an orientation rotated of 45 degrees relative to the main axis of the junction.

The combination network includes a 3 dB coupler to transform the two orthogonal linear polarizations into two orthogonal circular polarizations.

The junction of the waveguide orthomode transducer is designed to transmit/receive higher frequency bands through a port opposite to main port of the main waveguide, while coupling a lower frequency band towards the combination network said waveguide orthomode transducer.

The invention also concerns a method for combining or separating two orthogonal linear polarizations whose main axis are rotated of 45 degrees in comparison with the two main axis defined by the auxiliary rectangular waveguides.

In particular, according to a second aspect, the invention concerns a method for separating two orthogonal linearly polarized electromagnetic fields by means of the waveguide orthomode transducer of the first aspect of the invention, the method comprising the steps of: entering two orthogonal linearly polarized electromagnetic fields (vertical and horizontal) in the main waveguide with an orientation of 45° relative to the main axis of the junction; directing the two orthogonally polarized signals (vertical or horizontal) entering the common-ports of the magic tees towards different outputs of the magic tees (resp. E-port or H-port); exiting the combination network through respective tee junctions (H-plane power combiner for the vertical polarization and E-plane power combiner for the horizontal polarization).

And according to a third aspect due to the reciprocity of electromagnetic passive components, the invention concerns a method for combining two signals as orthogonal linear polarizations in a same main waveguide by means of the waveguide orthomode transducer of the first aspect of the invention, the method comprising the steps of entering the radio frequency signals at said tee junctions; exiting by the main waveguide the signal having two orthogonal linear polarizations (one per signal entering each tee junction) with an orientation of 45° relative to the main axis of the junction.

According to a fourth aspect, the invention concerns an antenna device comprising a waveguide orthomode transducer according to the first aspect of the invention.

The waveguide orthomode transducer according to the first aspect of the invention can be designed to transmit/receive higher frequency bands through a port opposite to main port of the main waveguide, while coupling a lower frequency band towards the combination network said waveguide orthomode transducer.

And according to a fifth aspect, the invention concerns a multi-band antenna device comprising a least one waveguide orthomode junction according to the above design.

BRIEF DESCRIPTION OF THE DRAWINGS

Other features and advantages of the invention will appear in the following description. Embodiments of the invention will be described with reference to the drawings, in which FIG. 1—already discussed—illustrates a conventional turnstile junction.

DETAILED DESCRIPTION OF THE INVENTION

Design of the Waveguide Orthomode Transducer

The Non-Conventional Use of the Turnstile Junction

Figure 1:
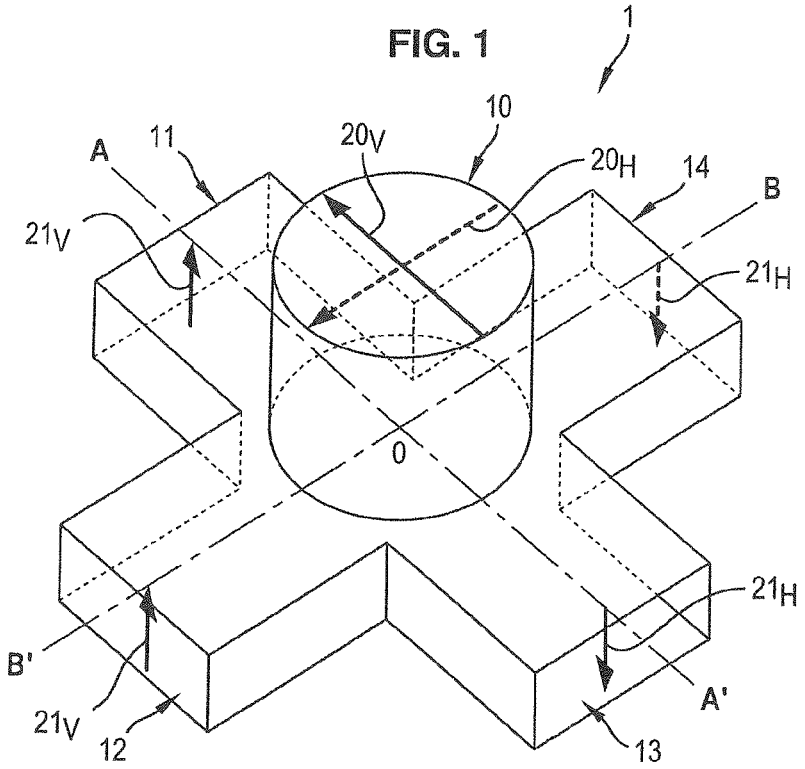

The waveguide orthomode transducer is based on a non-conventional use of the turnstile junction. In fact, the conventional turnstile junction can separate by itself two orthogonal polarizations, the complexity then comes from the combination network (see FIG. 1).

Figure 2:
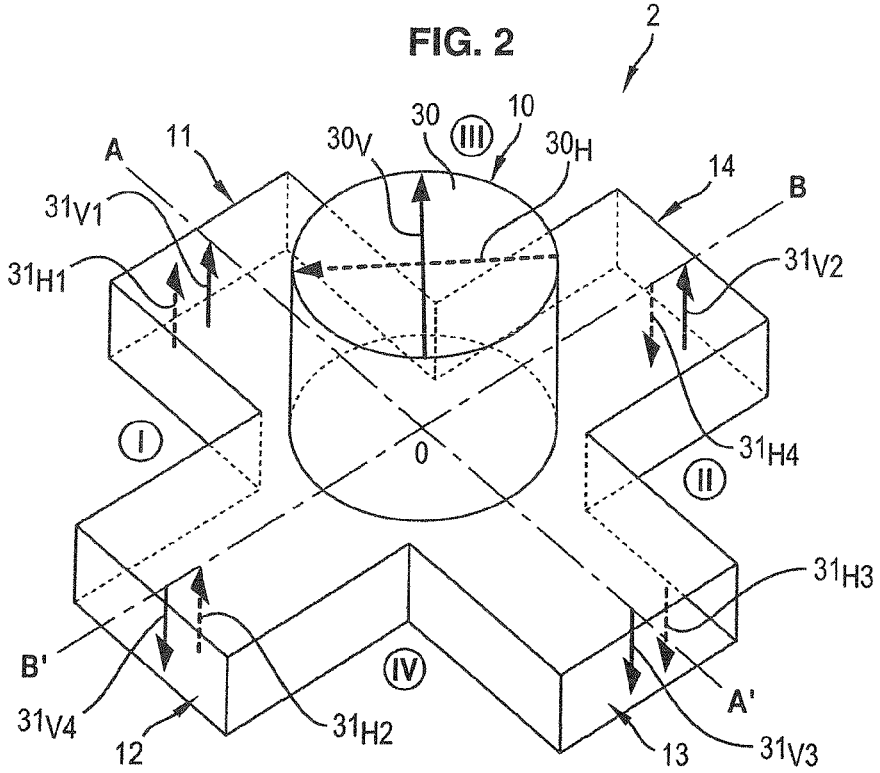
FIG. 2 illustrates the non-conventional use of the known turnstile junction in the OMT of the invention.

FIG. 2 illustrates the non-conventional use of the turnstile junction.

In order to reduce the complexity of the combination network without crossings, the conventional junction is 45 degrees rotated which means that the signal enters in the transducer by the main waveguide 10 according to an orientation of 45° relative to the main axis AA', BB' of the junction 2.

A consequence of such a rotation is that the two polarizations are present in the four auxiliary waveguides 11-14, and the power of the radio-frequency signal entering in the transducer is divided by four.

A radio-frequency signal including vertically polarized mode $\mathbf{30}_V$ and a horizontally polarized mode $\mathbf{30}_H$ (these modes are orthogonals) enters in the main circular waveguide 10 of the junction 2 according to an orientation of 45° relative to the main axis AA', BB' of the junction 2.

One can note that when the junction is associated to a transmit antenna the radio-frequency signal exits the junction according to an orientation of 45° relative to the main axis AA', BB' of the junction 2.

The vertically polarized field $\mathbf{30}_V$ is divided into fields $\mathbf{31}_{V1}$, $\mathbf{31}_{V2}$, $\mathbf{31}_{V3}$ and $\mathbf{31}_{V4}$. The signals $\mathbf{31}_{V1}$ and $\mathbf{31}_{V2}$ are in phase but out-of-phase with signals $\mathbf{31}_{V3}$ and $\mathbf{31}_{V4}$.

Similarly the horizontally polarized field $30_H$ is divided into electromagnetic fields $31_{H1}$, $31_{H2}$, $31_{H3}$ and $31_{H4}$. The two signals $31_{H1}$ and $31_{H4}$ are in phase but out-of-phase with signals $31_{H2}$ and $31_{H3}$.

With a proper combination of the junction and an appropriate combination network, the polarizations can be separated (resp. combined) for an OMT associated to an antenna acting as a receiver (resp. transmitter).

Figure 5:
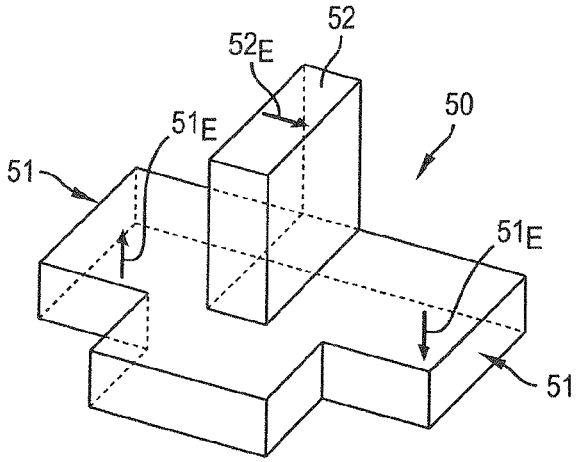
FIG. 5 illustrates an E-plane tee junction used in the OMT of the invention.

FIG. 5 illustrates the non-conventional use of the turnstile junction 2 with the combination network surrounding it.

Combination Network

The combination network, when it operates as a receiver (resp. transmitter), comprises magic tees 30 for separating (resp. combining) the polarizations in association with H-plane 40 and E-plane 50 tee junctions operating as power combiners (resp. power dividers).

The combination network comprises two magic tees 30, each having an E-port 33, two opposed common-ports 31, and an H-port 32, an H-plane tee junction 40 and an E-plane tee junction 50.

Figure 3:
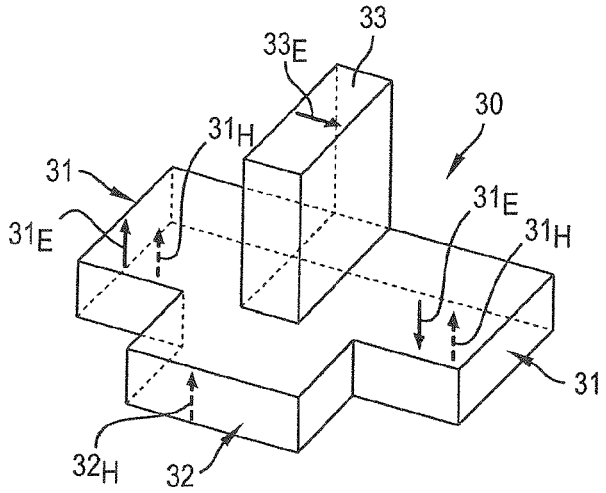
FIG. 3 illustrates a magic tee used in the OMT of the invention.

FIG. 3 illustrates a magic tee.

Figure 4:
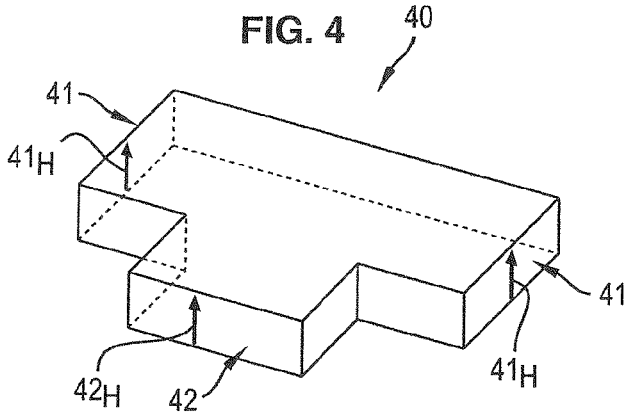
FIG. 4 illustrates an H-plane tee junction used in the OMT of the invention.

FIG. 4 illustrates an H-plane tee junction and FIG. 5 illustrates an E-plane tee junction.

The magic tee 30 can be used as an H-plane power combiner to combine two in-phase electromagnetic fields $31_H$ entering by common-ports 31 into one electromagnetic field $32_H$ exiting by H-port 32. Used as an H-plane power divider, the magic tee 30 splits one electromagnetic field entering in H-port 32 into two half power in-phase electromagnetic fields.

The magic tee 30 can also be used as an E-plane power combiner to combine two out-of-phase electromagnetic fields $31_E$ entering by common-ports 31 into one higher power electromagnetic field $33_E$ exiting by ports 33. Used as an E-plane power divider, the magic tee 30 splits one electromagnetic field entering in E-port 33 into two half power out-of-phase electromagnetic fields exiting the structure by the two common-ports 31.

When used as an H-plane power combiner/divider the electromagnetic fields propagate through the H-port 32 and the common-ports 31 while the E-port 33 has no active role. Used as an E-plane power combiner/divider, the electromagnetic fields propagate through the E-port 33 and common-ports 31 while the H-port 32 has no active role.

FIG. 4 illustrates an H-plane tee junction.

The H-plane tee junction 40 can be used as a power combiner or a power divider. Used as a power combiner, two in-phase electromagnetic fields $41_H$ entering by ports 41 are summed to form the electromagnetic field $42_H$ exiting by port 42. Used as a power divider, the electromagnetic field $42_H$ entering by port 42 is divided into two half power in-phase electromagnetic fields $41_H$ exiting the structure by ports 41.

FIG. 5 illustrates an E-plane tee junction.

The E-plane tee junction 50 can be used as a power combiner or a power divider. Used as a power combiner, two out-of-phase electromagnetic fields $51_E$ entering by ports 51 are summed to form the electromagnetic field $52_E$ exiting by port 52. Used as a power divider, the electromagnetic field $52_E$ entering by port 52 is divided into two half power out-of-phase electromagnetic fields $51_E$ exiting the structure by ports 51.

Figure 6:
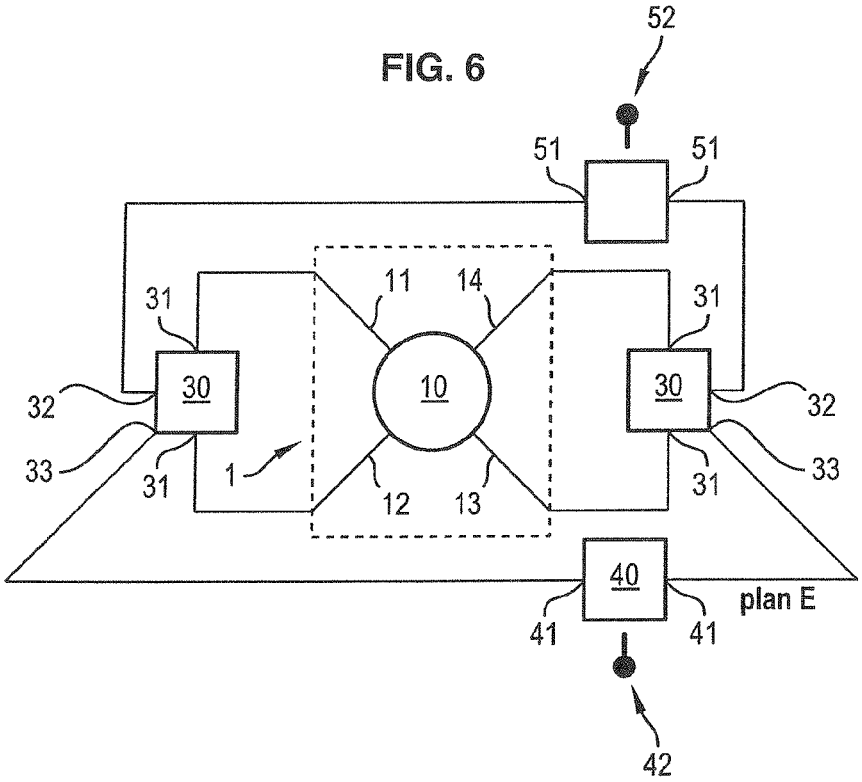
FIG. 6 illustrates the OMT with a turnstile junction and the associated combination network.

FIG. 6 illustrates the combination of the turnstile junction, the two magic tees, the H-plane and E-plane tee junctions required to separate/combine two orthogonal linear polarizations.

The structure is described assuming that it is associated to a receive antenna but according to the descriptions above of all elementary components, it can be used also in association with a transmit antenna.

In the case of an OMT used to separate two orthogonal linear polarizations, a vertical and a horizontal electromagnetic field enter the turnstile junction. The total power is divided in four towards the four auxiliary rectangular waveguides.

For the vertical polarization, signals going to upper auxiliary rectangular waveguide ports are in-phase but out-of-phase with signals going to lower auxiliary rectangular waveguide ports.

For the horizontal polarization, signals going to right auxiliary rectangular waveguide ports are in-phase but out-of-phase with signals going to left auxiliary waveguide ports.

Signals from the vertical polarization arriving in the common-ports of the magic tees are out-of-phase: they combine towards the E-port according to description above of elementary components.

Signals from the horizontal polarization arriving in the common-ports of the magic tees are in-phase: they combine towards the H-port according to description above of elementary components.

The two vertical polarization signals exiting the E-ports of the two magic tees are in-phase and are then combined with an H-plane power combiner.

The two horizontal polarization signals exiting the H-ports of the two magic tees are out-of-phase and are then combined with a E-plane power combiner.

Using the OMT of the invention, the vertical polarization exits the structure by the port 42 of the H-plane combiner and the horizontal polarization exits the structure by the port 52 of an E-plane combiner.

The proposed structure separates/combines polarizations with only two components per electrical path (a magic tee plus a tee junction) without any crossings or waveguide cross-section modification.

The structure is also fully symmetric per polarization, which is expected to result in low higher order modes generation.

This concept can be adapted to an orthomode transducer with longitudinal coupling slots, but this design has lower power handling and lower bandwidth.

The structure of the above described OMT has been described to separate two orthogonal linear polarizations. But it can also be associated with a 3 dB/90° coupler in order to separate/combine two orthogonal circular polarizations.

Also, it can be designed with orthomode junctions to transmit/receive higher frequency bands through a port opposite (not shown) to main port 30 of the main waveguide 10, while coupling a lower frequency band towards the combination network.

Such a junction may have a progressive cross-section reduction or irises that prevent lower frequency f band to propagate through the port opposite to main port 30.

Properly designed, the power on the lower frequency band is totally directed towards the combination network.

Associating at least two orthomode junctions enables to separate/combine orthogonally polarized electromagnetic signals from multiple frequency bands.

Furthermore, to simplify the association of the waveguide orthomode transducer with an antenna, typically a circular horn, the main waveguide access was described with a circular cross-section. But in some cases, it may be of interest to have a main waveguide with square or octagonal cross-section.

Ku-Band OMT Design

To illustrate the case of a use of a turnstile junction, a Ku-band OMT has been designed.

Corresponding frequency bands for satellite telecommunications are [10.95-12.75 GHz] for transmit and [13.75-14.5 GHz] for receive.

The turnstile junction and the magic tee were optimized separately, while the E-plane and H-plane tees junctions were optimized with the bends linked to their common-ports due to a significant impact on performances.

All the components are standard design components. A WR75 standard waveguide cross section is used over the full combination network.

Figure 7A:
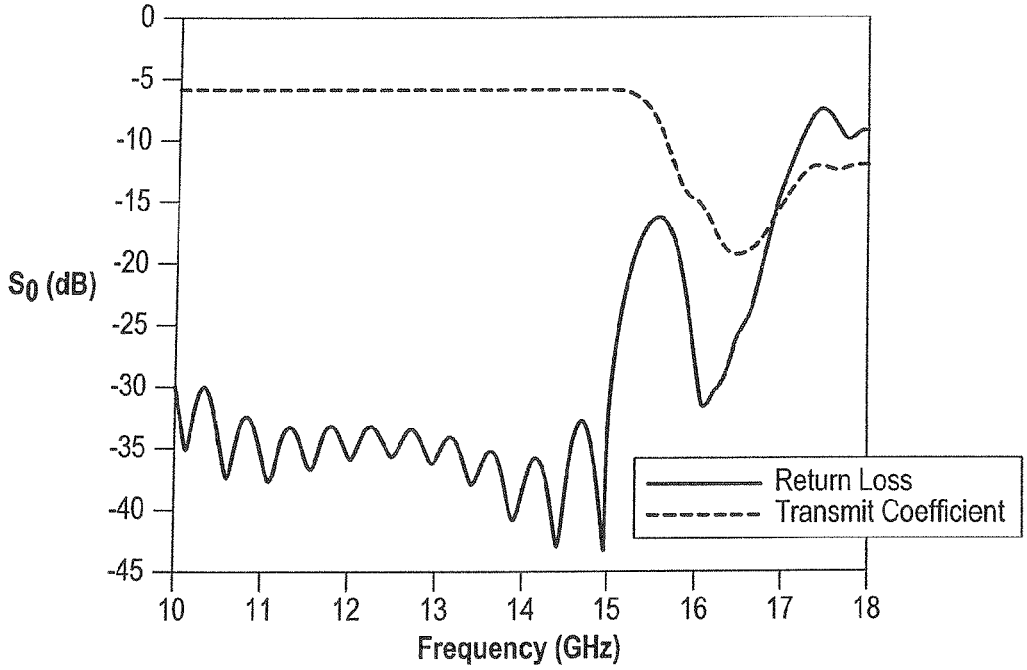
FIG. 7*a* and FIG. 7*b* illustrate typical turnstile junction and magic tee performances.
Figure 7B:
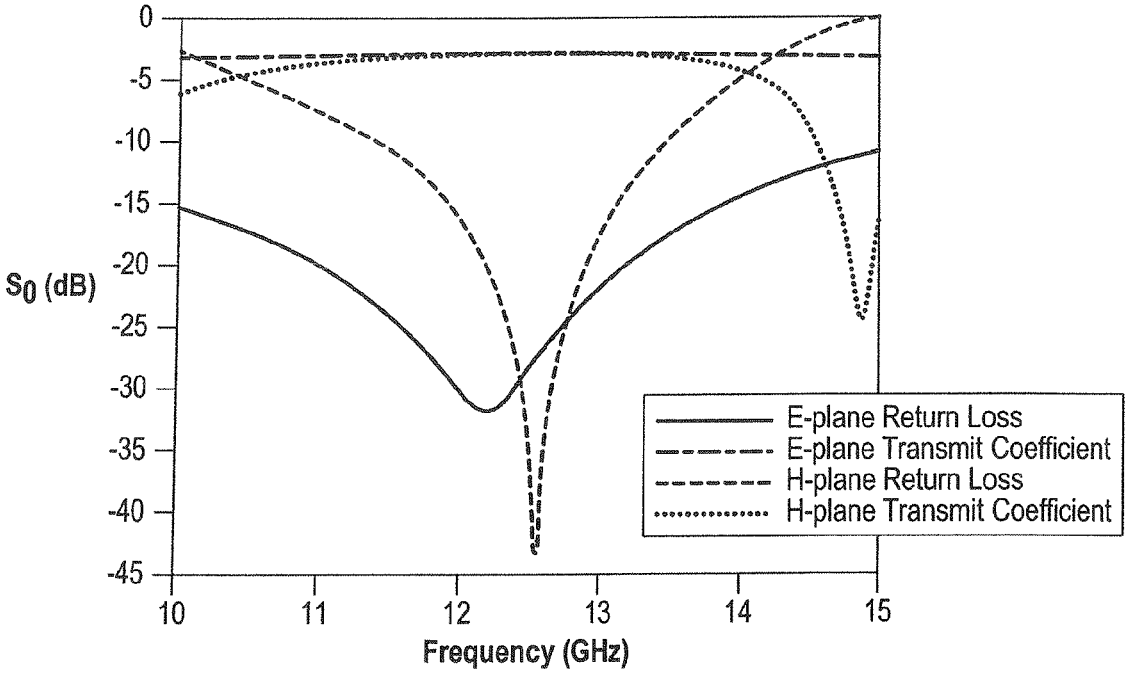
Figure 8A:
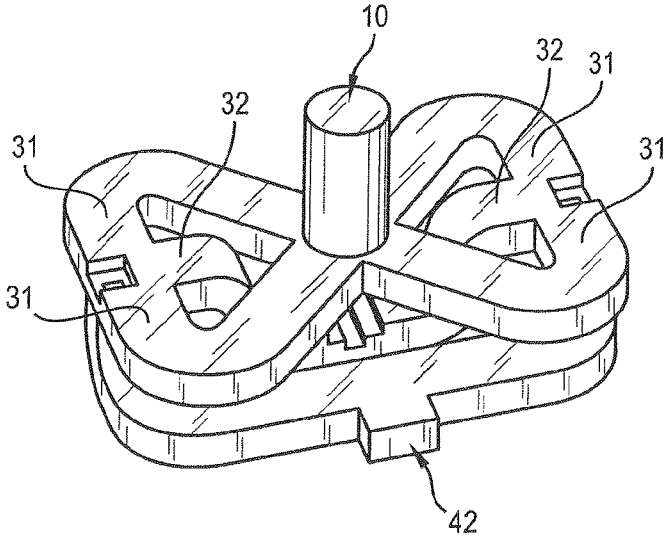
FIG. 8*a* and FIG. 8*b* illustrate top and bottom views of a possible Ku-Band design of the OMT according to the invention.
Figure 8B:
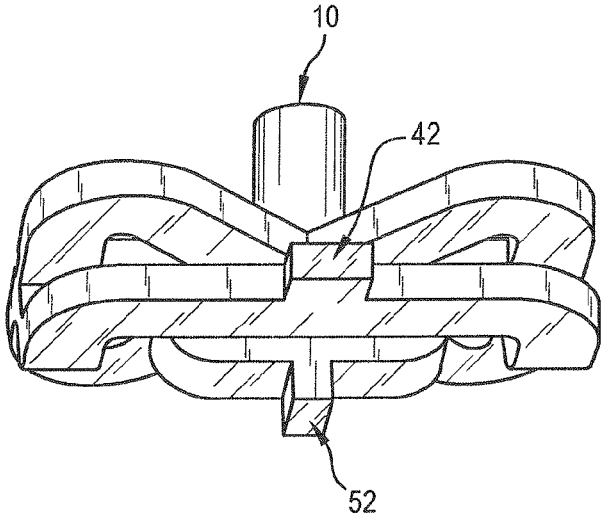

FIGS. 7*a* and 7*b* illustrate respectively the turnstile junction and the magic tees performances of the Ku-Band OMT design.

Concerning the turnstile junction, very wideband behaviour is achieved from 10 to 15 GHz, with very flat transmit coefficients.

Due to component symmetry, all the transmit coefficients are equal in amplitude. Level is close to the theoretical −6.02 dB over the desired bandwidth.

Phase performances are also close to theoretical values with corresponding in-phase and out-of-phase transmit coefficients. For information, performances beyond 15 GHz are also reported. We can notice a significant degradation due to higher order modes.

For accuracy purpose, multi-mode analysis considered up to ten modes per port.

As it can be seen in FIG. 7*b*, the bandwidth of the H-plane port is much narrower than the E-plane port one for the magic tee. Since acceptable performances are achieved over 1 GHz bandwidth, from approximately 12 to 13 GHz.

To improve the overall design performances, magic tees with wider bandwidth characteristics, based for example on irises, ridged waveguides, etc. can be used.

Figure 9A:
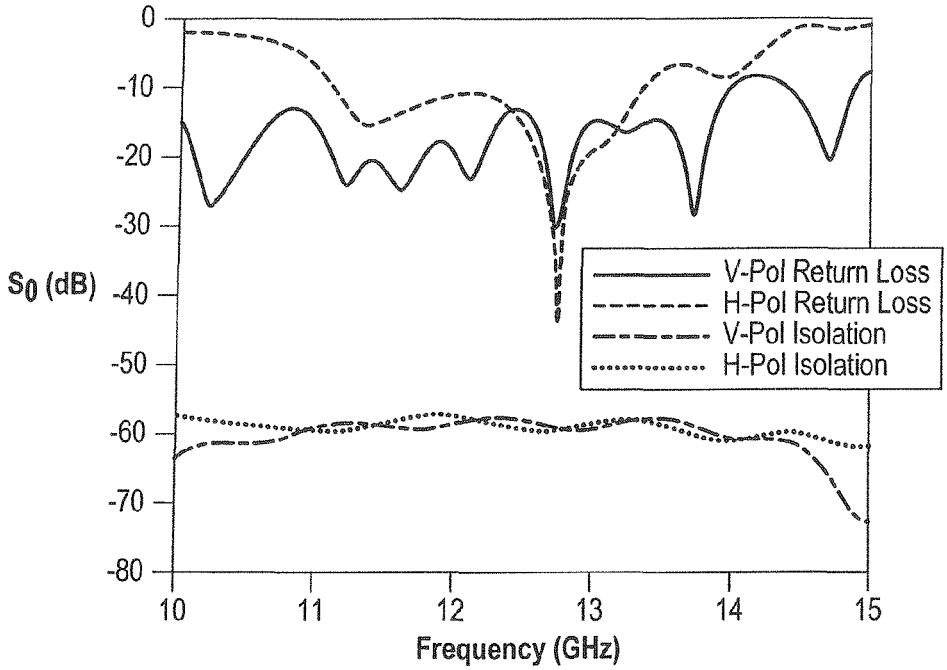
FIG. 9*a* and FIG. 9*b* illustrate typical results of the OMT of the invention for the horizontal and the vertical polarizations.
Figure 9B:
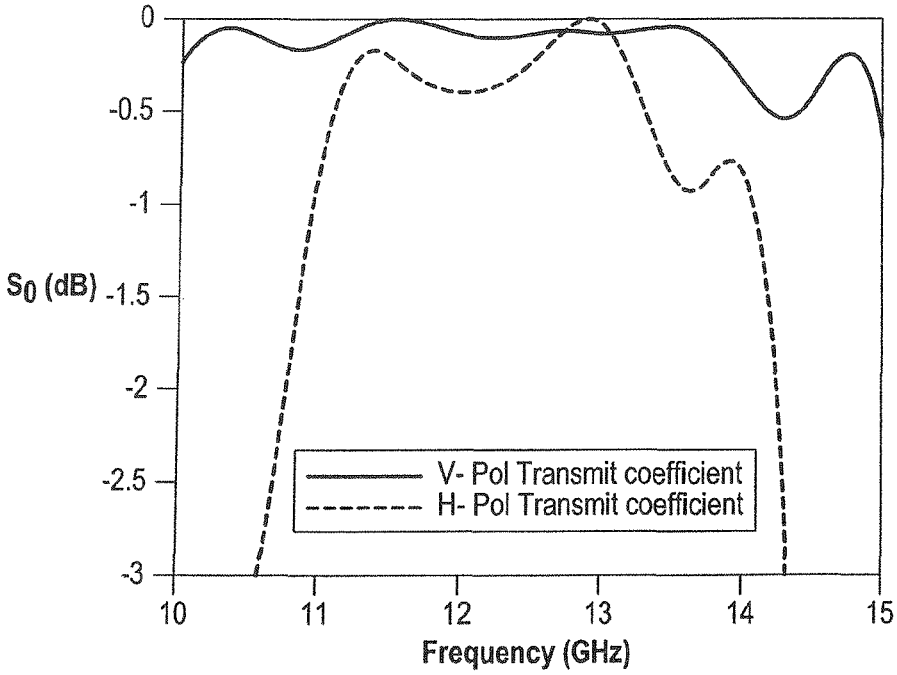

FIGS. 9*a* and 9*b* illustrate the simulated performances of the Ku-Band OMT design in terms of return loss, transmit and isolation results for both the vertical and horizontal polarizations (resp. V-Pol and H-Pol).

One can note that the vertical polarization has wider bandwidth behaviour than the horizontal one, the main reason being the magic tee limitations (horizontal polarization signals are combined through the H-plane ports of the magic tees).

Return losses better than −10 dB are achieved for the two polarizations over a bandwidth of about 2.2 GHz from 11.1 to 13.3 GHz.

Insertion losses are better than 0.6 dB over this frequency range. These losses do not consider ohmic losses, the metal being considered in simulation as a perfect conductor.

As far as isolation is concerned, it is interesting to note that simulated performances are close to −60 dB over a large bandwidth (see FIG. 9*a*). This is a typical value for standard turnstile junctions. It means that despite our non-conventional use of the turnstile junction, standard performances can be reached for this parameter.

The invention claimed is:

1. A waveguide orthomode transducer, comprising:

a junction having a main waveguide and four auxiliary waveguides lying along the two orthogonal main axis of the junction and defining four quadrants (I, II, III, IV);

a combination network comprising two magic tees, each having an E port, two opposed common-ports, and a H-port;

an E-plane tee junction having a Σ-port and two opposed common-ports; and an E-plane tee junction having a Δ-port and two opposed common-ports;

wherein:

two auxiliary waveguides defining a first quadrant (I) are respectively connected to the common-ports of one of the magic tees and the two other secondary waveguides defining a second quadrant (II) opposite to the first quadrant (I) are connected to the common-ports of the other magic tee; and in that tee junctions are used to connect similar magic tee ports (E-port, H-port);

so that the transducer separates towards two different outputs two orthogonally polarized signals entering at said main waveguide and reciprocally two signals entering respectively in the Σ-port and the Δ-port of the tees junctions are combined with orthogonal polarizations in said main waveguide.

2. A waveguide orthomode transducer according to claim 1 wherein the E-ports of each magic tees are connected to the common-ports of the H-plane tee junction; and the H-ports of each magic tees are connected to the common ports of the E-plane tee junction.

3. A waveguide orthomode transducer according to claim 1, wherein the main waveguide has a circular, square or octagonal cross-section.

4. A waveguide orthomode transducer according to claim 1, wherein the auxiliary waveguides are rectangular waveguides with longest side orthogonal to the main waveguide longitudinal axis, the junction being a turnstile junction; or rectangular waveguides with longest side parallel to the main waveguide longitudinal axis.

5. A waveguide orthomode transducer according to claim 1, wherein said transducer is adapted to receive/transmit a radio frequency signal including two orthogonal linearly polarized electromagnetic fields with an orientation rotated of 45 degrees relative to the main axis of the junction.

6. A waveguide orthomode transducer according to claim 1, wherein the combination network includes a 3 dB coupler to transform the two orthogonal linear polarizations into two orthogonal circular polarizations.

7. A waveguide orthomode transducer according to claim 1, wherein the junction is designed to transmit/receive higher frequency bands through a port opposite to main port of the main waveguide, while coupling a lower frequency band towards the combination network said waveguide orthomode transducer.

8. A multi-band antenna device comprising at least one waveguide orthomode junction according to claim 7.

9. A method for separating two orthogonal linearly polarized electromagnetic fields by means of the waveguide orthomode transducer of claim 1, the method comprising the steps of:

entering in the main waveguide with an orientation of 45° relative to the main axis of the junction;

directing the two orthogonally polarized signals entering the common-ports of the magic tees towards different outputs of the magic tees;

exiting the combination network through respective tee junctions, H-plane power combiner for the vertical polarization and E-plane power combiner for the horizontal polarization.

10. A method for combining two signals as orthogonal linear polarizations in a same main waveguide by means of the waveguide orthomode transducer of claim 1, the method comprising the steps of:

entering the radio frequency signals at said tee junctions;

exiting by the main waveguide the signal having two orthogonal linear polarizations, one per signal entering each tee junction, with an orientation of 45° relative to the main axis of the junction.

11. An antenna device comprising a waveguide orthomode transducer according to claim 1.

* * * * *